US008281728B2

(12) United States Patent
Washino et al.

(10) Patent No.: US 8,281,728 B2
(45) Date of Patent: Oct. 9, 2012

(54) STEERING APPARATUS FOR OUTBOARD MOTOR

(75) Inventors: Keishi Washino, Yokohama (JP); Yoshihiro Makita, Yokohama (JP)

(73) Assignee: NHK MEC Corporation, Yokohama-Shi (JP)

( * ) Notice: Subject to any disclaimer, the term of this patent is extended or adjusted under 35 U.S.C. 154(b) by 0 days.

(21) Appl. No.: 13/220,352

(22) Filed: Aug. 29, 2011

(65) Prior Publication Data

US 2012/0045951 A1 Feb. 23, 2012

Related U.S. Application Data

(63) Continuation of application No. PCT/JP2011/060536, filed on May 2, 2011.

(30) Foreign Application Priority Data

Aug. 19, 2010 (JP) ..... 2010-184194

(51) Int. Cl.
*B63H 20/12* (2006.01)

(52) U.S. Cl. ..... 114/144 R; 192/90

(58) Field of Classification Search ..... 114/144 R, 114/144 RE; 192/89.2, 70.2, 84.7, 90; 440/64
See application file for complete search history.

(56) References Cited

U.S. PATENT DOCUMENTS

| | | | | |
|---|---|---|---|---|
| 4,120,258 | A * | 10/1978 | Spurgin | 114/144 E |
| 4,397,380 | A * | 8/1983 | Yew | 192/84.51 |
| 7,097,520 | B2 * | 8/2006 | Okumura et al. | 440/1 |
| 7,137,347 | B2 | 11/2006 | Wong et al. | |
| 2006/0042532 | A1 | 3/2006 | Wong et al. | |

FOREIGN PATENT DOCUMENTS

JP 2007-91213 A 4/2007

OTHER PUBLICATIONS

International Search Report (ISR) dated Aug. 9, 2011 in counterpart International Application No. PCT/JP2011/060536.

* cited by examiner

*Primary Examiner* — Edwin Swinehart
(74) *Attorney, Agent, or Firm* — Holtz, Holtz, Goodman & Chick, PC

(57) ABSTRACT

A case of a helm device is provided with a steering shaft. A rotation of the steering shaft is detected by a helm sensor. A friction generating mechanism is disposed in the case. The friction generating mechanism includes a rotor disposed on the steering shaft, an inner disk configured to rotate together with the rotor, an outer disk opposed to the inner disk, an electromagnetic actuator, and an armature configured to be driven by the electromagnetic actuator. An assist spring is disposed in the case. The assist spring urges the armature in such a direction as to press the disks against each other.

12 Claims, 13 Drawing Sheets

STEERING APPARATUS FOR OUTBOARD MOTOR

CROSS-REFERENCE TO RELATED APPLICATIONS

This application is a Continuation Application of PCT Application No. PCT/JP2011/060536, filed May 2, 2011 and based upon and claiming the benefit of priority from prior Japanese Patent Application No. 2010-184194, filed Aug. 19, 2010, the entire contents of all of which are incorporated herein by reference.

BACKGROUND OF THE INVENTION

1. Field of the Invention

This invention relates to a steering apparatus for an outboard motor, and particularly, to a steering apparatus comprising a helm unit configured to be operated by means of a steering wheel.

2. Description of the Related Art

Conventionally, there has been known a steering apparatus for an outboard motor in which a hydraulic pump is provided on, for example, a helm (steering wheel), and a hydraulic actuator configured to be driven by the hydraulic pump is disposed near the outboard motor. In this steering apparatus, an oil pressure produced by the hydraulic pump serves to redirect the outboard motor. Also known is a mechanical steering apparatus that redirects an outboard motor by transmitting a rotary motion of a steering wheel to the outboard motor by means of a push-pull cable. Since these steering apparatuses are operated manually (or by an operator's power), they require a considerably large operating force, depending on the boat operating conditions, and hence, leave room for improvement.

Thus, as disclosed in, for example, U.S. Pat. No. 7,137,347 B2 (Patent Document 1), a steering apparatus may be contrived such that a sensor for detecting the manipulated variable of a steering wheel is disposed in a helm unit. An electric actuator unit for use as a drive source for steering is driven by electrical signals output from the sensor. In the steering apparatus of this type, the actuator unit is driven based on the sensor output, so that the steering wheel can be turned with little force. In some cases, however, it is undesirable to allow the steering wheel to be turned excessively with little force, so that the helm unit is provided with a friction generating mechanism.

The friction generating mechanism of the steering apparatus described in Patent Document 1 produces a frictional force by means of an electromagnetic actuator. If a power failure occurs in the electromagnetic actuator due to power supply trouble or the like, therefore, the steering wheel may be suddenly turned with little force. In this case, the operation of the steering wheel is perplexing, and in addition, wrong operation of a boat may occur.

BRIEF SUMMARY OF THE INVENTION

Accordingly, the object of this invention is to provide a steering apparatus for an outboard motor, capable of producing an appropriate resistance in operating a steering wheel.

The present invention is a steering apparatus for an outboard motor which has a helm device. The helm device comprises a case, a steering shaft rotatably disposed in the case and configured to be rotated by a steering wheel, a helm sensor configured to detect turning of the steering shaft, and a friction generating mechanism accommodated in the case.

The friction generating mechanism comprises an inner disk configured to rotate together with the steering shaft, an outer disk opposed to the inner disk, an electromagnetic actuator, an armature configured to move in such a direction as to press the inner disk and the outer disk against each other when the electromagnetic actuator is supplied with electric power, and an assist spring configured to continually urge the armature in the direction to press the inner disk and the outer disk against each other.

One embodiment of the present invention comprises a control unit which controls the electromagnetic actuator and means for changing the electric power supplied to the electromagnetic actuator, thereby changing a frictional force produced between the inner disk and the outer disk of the friction generating mechanism. Further, the steering apparatus may comprise an adjustment control unit capable of setting the frictional force of the friction generating mechanism.

The control unit may comprise means for supplying the electromagnetic actuator with electric power such that the inner disk and the outer disk are brought into a locked state when a preset turning position is reached by the turning position of the steering wheel starting from a neutral position. Further, the steering apparatus may comprise an adjustment control unit capable of setting a number of turns of helm at which the steering wheel is turnable before the locked state is established starting from the neutral position.

One embodiment of the present invention may comprise a rotor configured to rotate together with the steering shaft, a spline formed on the rotor, a tooth portion formed on the inner disk and configured to engage with the spline, and a gap defined between the spline and the tooth portion and configured to allow the steering shaft to pivot relative to the inner disk through or beyond an angle exceeding the angle-detection resolution of the helm sensor when the inner disk and the outer disk are in the locked state. Further, a plurality of the inner disks may be arranged along an axis of the steering shaft, and the steering apparatus may comprise an alignment member for aligning the positions of the respective tooth portions of the inner disks with one another.

Another embodiment of the present invention comprises a holder member disposed on an end portion of the steering shaft and movable along the axis of the steering shaft, a member to be detected disposed on the holder member, and a spring member disposed in the steering shaft and configured to urge the holder member toward the helm sensor, thereby keeping the distance from the member to be detected to the helm sensor constant.

One embodiment of the present invention comprises a circuit board accommodated in the case, an end surface formed on the case and supported on a helm mounting wall of a boat body, first and second through-holes formed in the helm mounting wall, a mounting bolt projecting from the end surface of the case toward the helm mounting wall and inserted into the first through-hole, and a conducting member electrically connected to the circuit board and inserted into the second through-hole.

According to the present invention, steering effort (resistance) on the steering wheel can be adjusted by operating the friction generating mechanism by means of the electromagnetic actuator attached to the helm device. In case of discontinuity due to power supply trouble of the electromagnetic actuator or the like, moreover, the assist spring can apply some resistance to the steering wheel, so that such a problem can be avoided that the operation of the steering wheel suddenly becomes lighter.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A boat comprising a steering apparatus according to a first embodiment of the present invention will now be described with reference to FIGS. 1 to 13.

Figure 1:
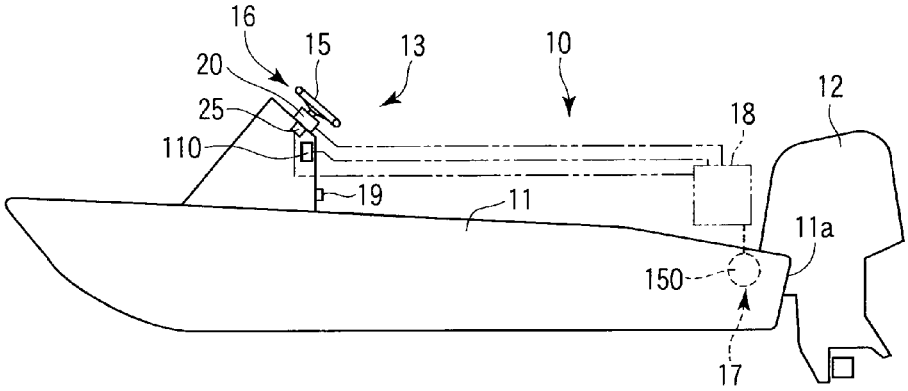
FIG. 1 is a side view of a boat comprising a steering apparatus according to a first embodiment of the present invention.
Figure 2:
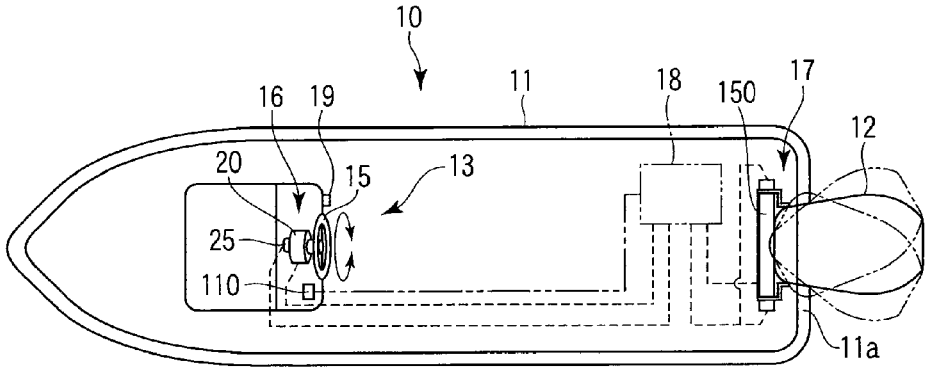
FIG. 2 is a plan view of the boat shown in FIG. 1.

FIGS. 1 and 2 show an example of a boat 10. The boat 10 comprises a boat body 11, outboard motor 12, and steering apparatus 13. The steering apparatus 13 comprises a helm unit 16 comprising a steering wheel 15, electric actuator unit 17 for steering disposed at the rear part of the boat body 11, control unit 18, and power switch 19. The actuator unit 17 functions as a drive source for changing the steering angle of the outboard motor 12. The control unit 18 is electrically connected to the helm unit 16 and actuator unit 17.

The helm unit 16, actuator unit 17, and control unit 18 are powered on or off by the power switch 19.

The helm unit 16 comprises a helm device 20 that is operated by means of the steering wheel 15. The helm device 20 will first be described with reference to FIGS. 3 to 7.

Figure 3:
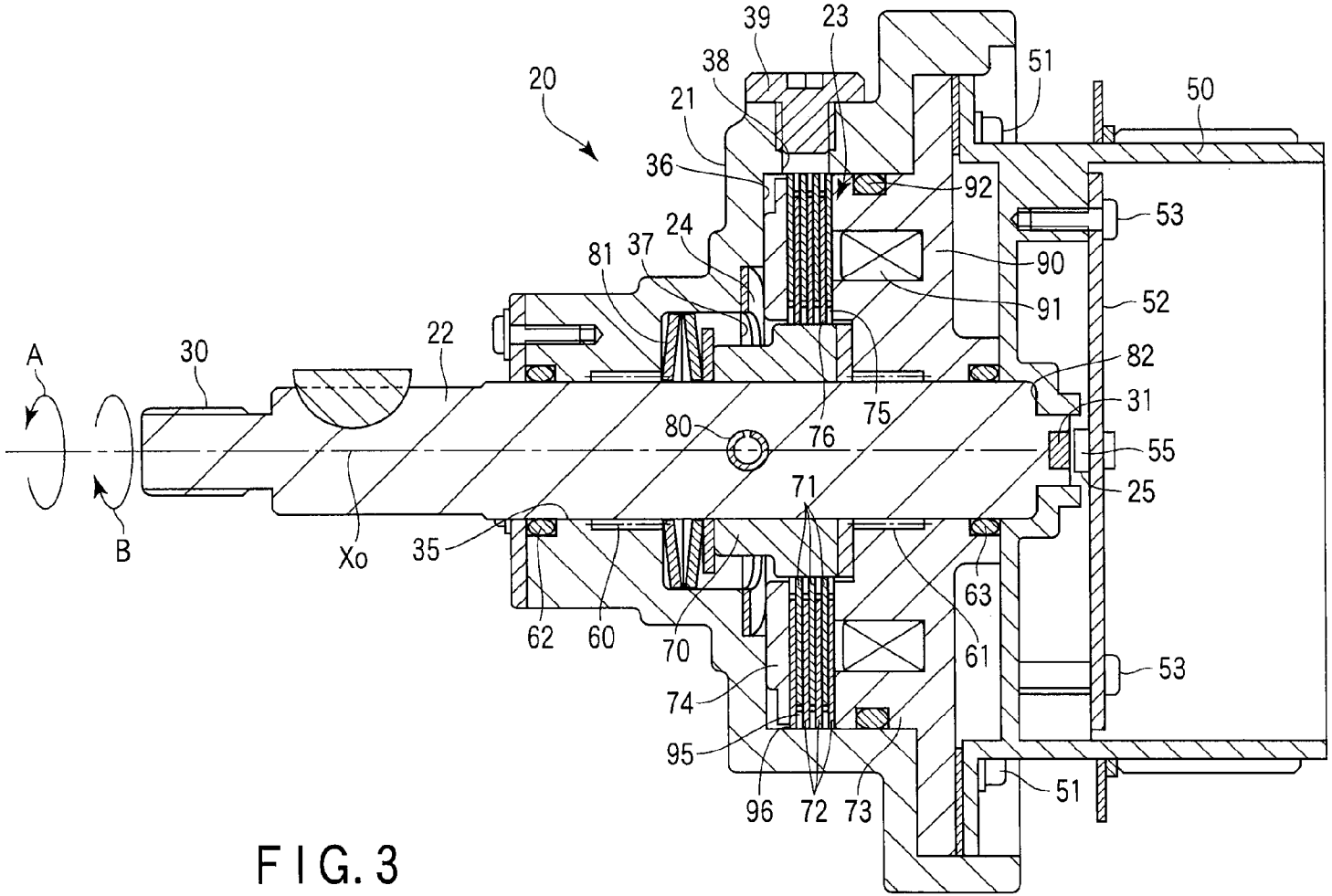
FIG. 3 is a sectional view of a helm device of the boat shown in FIG. 1.

FIG. 3 is a sectional view showing an example of the helm device 20. The helm device 20 comprises a waterproof case 21, steering shaft 22 inserted in the case 21, wet friction generating mechanism 23 disposed in the case 21, assist spring 24, and helm sensor 25 for detecting the operating angle of the steering wheel 15. The assist spring 24 is formed of an elastic member selected from a group including, for example, a wave spring, coned disc spring, wave washer, etc.

A fitting portion 30 to which the steering wheel 15 is secured is formed on one end portion of the steering shaft 22. A magnet 31 for use as a member to be detected that constitutes a part of the helm sensor 25 is disposed on the other end portion of the steering shaft 22. The steering shaft 22 is rotatable in first direction A and second direction B about axis $X_0$ (FIG. 3).

The case 21 is formed with a hole 35 into which the steering shaft 22 is inserted, chamber 36 that accommodates the friction generating mechanism 23, spring receiving surface 37 supporting the assist spring 24, oil filler port 38, etc. The oil filler port 38 is used to inject oil into the chamber 36. This oil filler port 38 is closed by means of a plug member 39 after the oil is introduced into the chamber 36.

A cover member 50 is secured to the rear part of the case 21 by fixing members 51. A circuit board 52 is secured to the cover member 50 by fixing members 53. An element 55 for detecting the magnet (member to be detected) 31 is disposed on the circuit board 52. The magnet 31 and element 55 constitute the helm sensor 25 for detecting the degree and direction of rotation of the steering shaft 22. An electrical signal corresponding to the manipulated variable (operating angle) of the steering shaft 22, detected by the helm sensor 25, is output to the control unit 18.

The steering shaft 22 is inserted into the hole 35 in the case 21. This steering shaft 22 is rotatably supported by bearing members 60 and 61. Seal members 62 and 63 are disposed between the steering shaft 22 and the inner peripheral surface of the hole 35.

Figure 4:
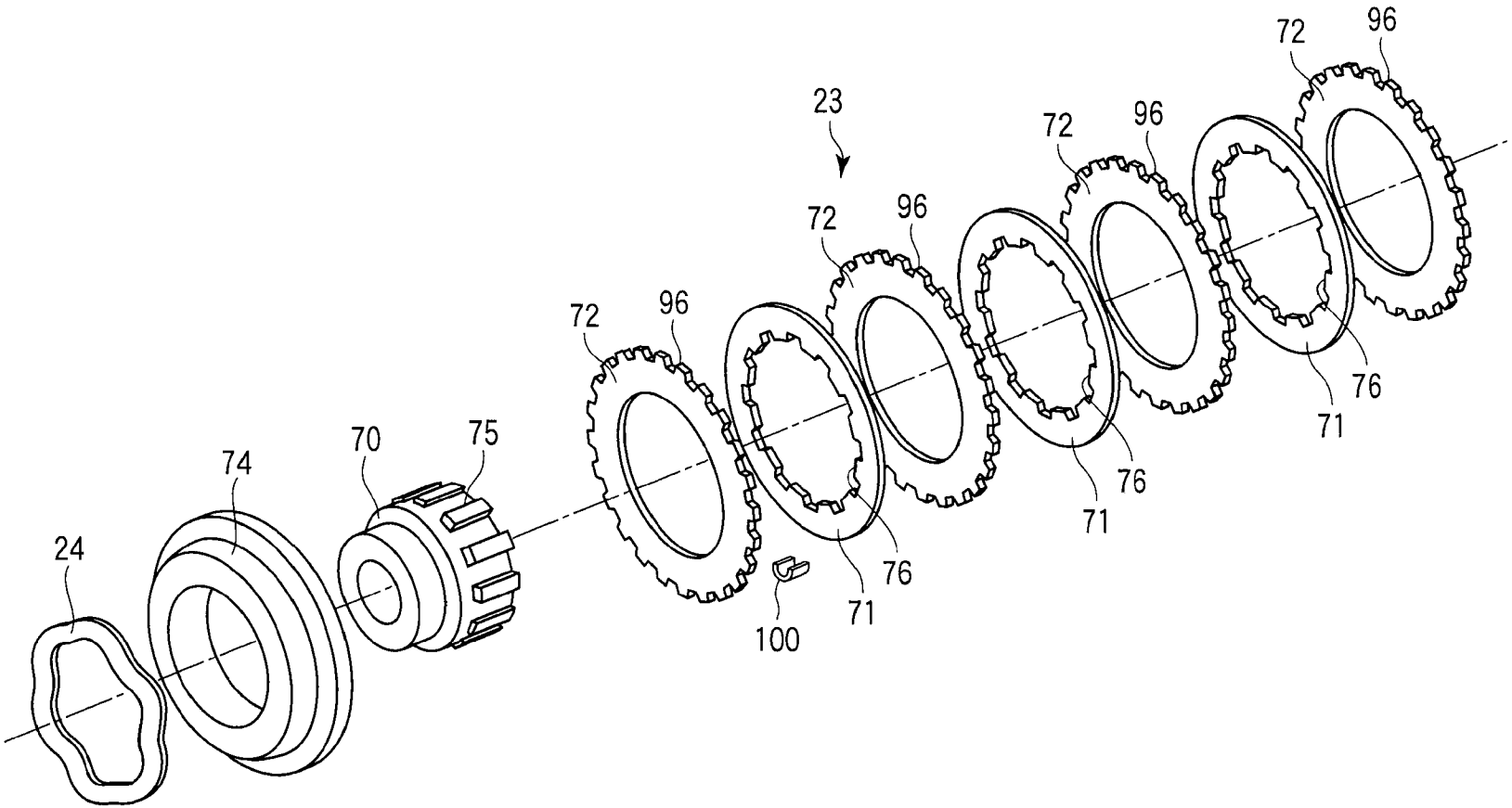
FIG. 4 is an exploded perspective view showing a part of a friction generating mechanism of the helm device shown in FIG. 3.

The friction generating mechanism 23 is accommodated in the chamber 36 in the case 21. FIG. 4 is an exploded perspective view showing a part of the friction generating mechanism 23.

The friction generating mechanism 23 comprises a rotor 70, a plurality of inner disks 71, a plurality of outer disks 72, electromagnetic actuator 73, and armature 74. The rotor 70 is mounted on the steering shaft 22. The inner disks 71 rotate integrally with the rotor 70. The outer disks 72 on the stationary side are opposed to the inner disks 71. The inner disks 71 and outer disks 72 are alternately arranged through the thickness. The friction generating mechanism 23 is in contact with the oil in the chamber 36.

A spline 75 extending along axis $X_0$ (FIG. 3) is formed on the outer peripheral surface of the rotor 70. Tooth portions 76 configured to mesh with the spline 75 are formed on the inner peripheral portion of each of the inner disks 71. Thus, the inner disks 71 are held on the rotor 70 for movement along axis $X_0$ and can rotate integrally with the rotor 70.

The rotor 70 is secured to the steering shaft 22 by a fixing member 80. An example of the fixing member 80 is a spring pin radially inserted into the steering shaft 22. The rotor 70 can rotate integrally with the steering shaft 22 about axis $X_0$. This steering shaft 22 is urged toward a support base 82 of the cover member 50 by an elastic member 81 such as a coned disc spring.

The electromagnetic actuator 73 comprises a yoke 90 of a magnetic material, such as a ferrous metal, and coil 91 formed of a copper wire. Electric power from a power source (not shown) is supplied to the coil 91 through the control unit 18. A seal member 92 is disposed between the outer peripheral surface of the yoke 90 and the inner peripheral surface of the case 21. The armature 74 is movable along axis $X_0$ of the steering shaft 22. This armature 74 is attracted toward the yoke 90 by a magnetic force produced when the coil 91 is powered. If the armature 74 is attracted toward the yoke 90, the inner disks 71 and outer disks 72 are pressed against one another.

The yoke 90 is secured to the case 21 by the fixing members 51. A spline 95 is formed on a part of the yoke 90. Tooth portions 96 are in mesh with the spline 95. The tooth portions 96 are formed on the respective outer peripheral portions of the outer disks 72. Thus, the outer disks 72 are movable relative to the case 21 along axis $X_0$ of the steering shaft 22. In addition, the outer disks 72 are held by the yoke 90 so that they cannot rotate relative to the case 21.

The assist spring 24 is disposed between the spring receiving surface 37 of the case 21 and the armature 74 in such a manner that it is deformed by an initial load. An example of the assist spring 24 is a wave washer of a spring material. The armature 74 is continually urged toward the yoke 90 by a repulsive load produced by the assist spring 24.

The electromagnetic actuator 73 attracts the armature 74 only while the coil 91 is powered. In other words, when the electromagnetic actuator 73 is not excited, the inner disks 71 and outer disks 72 are sandwiched between the armature 74 and yoke 90 to produce a frictional force (braking force) by the repulsive force of the assist spring 24 only.

On the other hand, the electromagnetic actuator 73 attracts the armature 74 by producing a magnetic force corresponding to the magnitude of the electric power supplied to the coil 91. When the electromagnetic actuator 73 is excited, therefore, the inner disks 71 and outer disks 72 are sandwiched between the armature 74 and yoke 90 by a combination of the repulsive force of the assist spring 24 and the attractive force of the electromagnetic actuator 73. Thus, the friction generating mechanism 23 produces a relatively large frictional force when the electromagnetic actuator 73 is excited. Since the frictional force of the friction generating mechanism 23 can be changed depending on the magnitude of the electric power supplied to the electromagnetic actuator 73, moreover, steering effort (resistance) on the steering wheel 15 can be changed.

Figure 5:
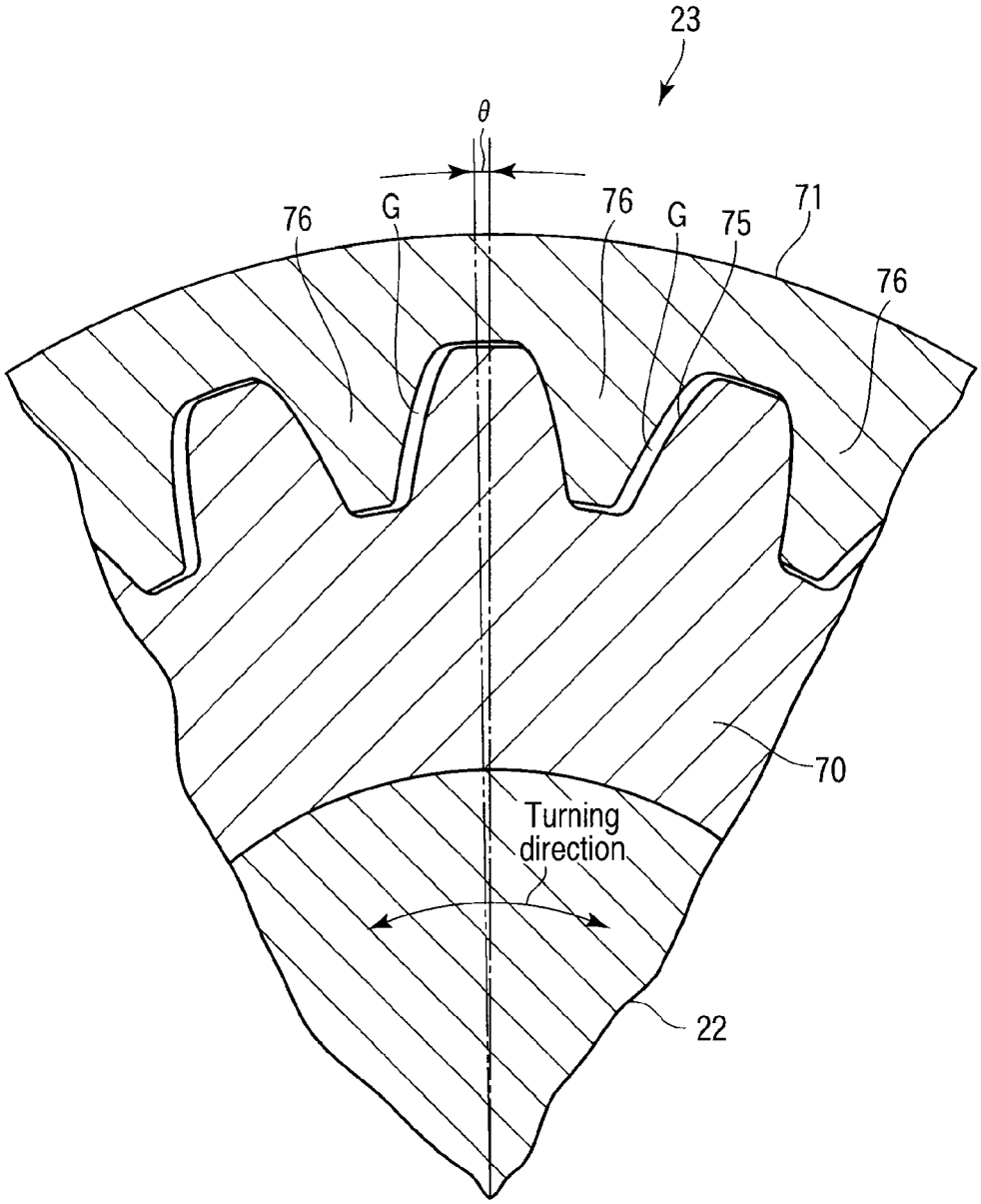
FIG. 5 is a sectional view showing a part of the friction generating mechanism shown in FIG. 4.

FIG. 5 shows a part of the rotor 70 and a part of the inner disk 71. As shown in FIG. 5, predetermined gap (play) G is defined between the spline 75 of the rotor 70 and each tooth portion 76 of the inner disk 71 in the direction of rotation of the rotor 70. This gap G allows the rotor 70 and inner disk 71 to relatively pivot through fine angle θ.

Angle θ through which the rotor 70 and inner disk 71 are allowed to relatively pivot by the gap G is greater than the resolution of the rotational angle of the steering shaft 22 detected by the helm sensor 25. Specifically, the steering shaft 22 is pivotable relative to the inner disks 71 within an angular range (angle θ) that exceeds the detection resolution of the helm sensor 25.

Thus, the steering shaft 22 can pivot relative to the inner disks 71 within the range of angle θ that exceeds the detection resolution of the helm sensor 25 with the inner disks 71 and outer disks 72 secured (or locked) to one another by the electromagnetic actuator 73.

Figure 6:
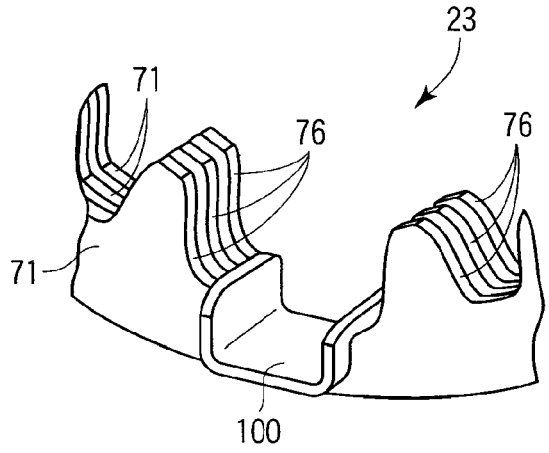
FIG. 6 is a perspective view showing a part of the friction generating mechanism shown in FIG. 4.

FIG. 6 shows an alignment member 100 attached to the inner disks 71. An example of the alignment member 100 is an elastic spring member, which is located covering the inner disks 71. This alignment member 100 controls the positions of the inner disks 71 in the direction of rotation so that the positions of the tooth portions 76 of the inner disks 71 are aligned with one another. The presence of the alignment member 100 can prevent the positions of the tooth portions 76 of the inner disks 71 from being shifted by disturbance such as vibration. In addition, the alignment member 100 can be somewhat deformed in the direction of rotation of the inner disks 71. When a torque is applied to the rotor 70, therefore, small positional shifts of the tooth portions 76 of the inner disks 71 are absorbed. By means of the alignment member 100, the tooth portions 76 of the inner disks 71 can be brought equally into contact with the spline 75.

Figure 7:
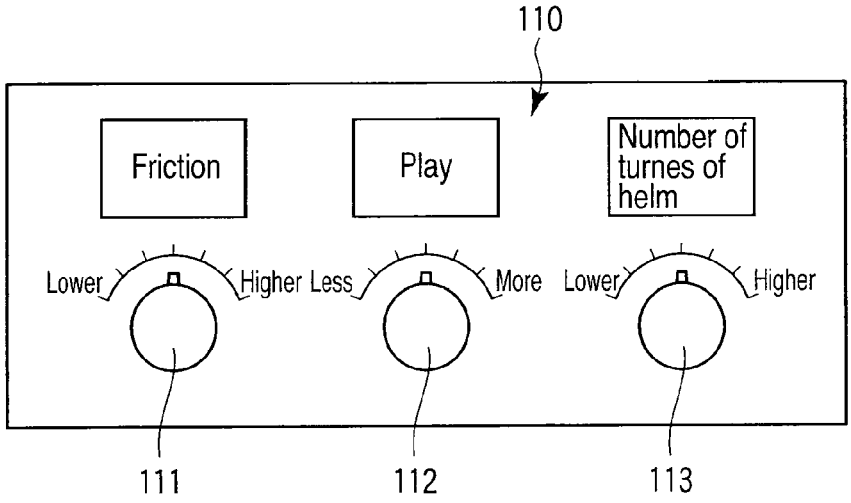
FIG. 7 is a front view of an adjustment control unit of a helm unit of the boat shown in FIG. 1.

The control unit 18 can change the electric power supplied to the coil 91 by means of an adjustment control unit 110 configured to be operated by a boat operator. FIG. 7 shows the adjustment control unit 110 disposed on a dashboard panel or the like of the helm unit 16. This adjustment control unit 110 comprises a friction adjustment section 111, play adjustment section 112, and setting section 113 for setting number of turns of helm.

When the friction adjustment section 111 is operated, the control unit 18 changes the electric power supplied to the electromagnetic actuator 73 in accordance with the manipulated variable. Specifically, the control unit 18 comprises a computer program for changing the electric power supplied to the electromagnetic actuator 73, as a means for changing the frictional force of the friction generating mechanism 23.

When the resistance (steering effort) against the operation of the steering wheel 15 is expected to be increased, for example, the friction adjustment section 111 is shifted to the "higher friction" side. Thereupon, the electric power supplied to the electromagnetic actuator 73 increases. Accordingly, the magnetic field of the electromagnetic actuator 73 is increased and the armature 74 is attracted with a greater force, so that the friction of the friction generating mechanism 23 increases. Thus, the steering effort can be increased. When the steering effort is expected to be reduced, in contrast, the electric power supplied to the electromagnetic actuator 73 can be reduced by shifting the friction adjustment section 111 to the "lower friction" side. Thus, the magnetic field of the electromagnetic actuator 73 is reduced, and hence, the friction of the friction generating mechanism 23 is reduced, so that the steering effort is reduced.

Even if the electromagnetic actuator 73 is de-energized due to power supply trouble or the like of the electromagnetic actuator 73, the armature 74 is continually urged toward the yoke 90 by the assist spring 24. Even in case of power supply trouble, therefore, the friction generating mechanism 23 can produce some frictional force even in the case of power supply trouble, so that the steering wheel 15 can avoid being excessively turned with little force and thereby causing a sudden change in the steering angle.

If the play adjustment section 112 is activated, the control unit 18 controls a signal output to the actuator unit 17 so that play is changed before the actuator unit 17 is actually activated after the steering wheel 15 is operated. The less the play, the more sensitively the actuator unit 17 is activated in response to the movement of the steering wheel 15.

Further, the control unit 18 comprises means (a computer program) for changing number of turns of helm when the setting section 113 is operated. The number of turns of helm implies the number of turns of the steering wheel 15 before the steering wheel 15 is locked after it is turned to a maximum steering angle from its neutral position. Thus, the control unit 18 and the setting section 113 for setting number of turns of helm are incorporated with a computer program capable of setting a number of turns of helm at which the steering wheel 15 can turn before the locked state is established starting from the neutral position.

If the degree of turning the steering wheel is increased by the setting section 113, for example, the operation amount of the actuator unit 17 relative to the turning angle of the steering wheel 15 is reduced when the boat 10 is navigating at high speed, for example. Thus, a sudden change of course can be suppressed. If the degree of turning the steering wheel is reduced by the setting section 113, in contrast, the operation amount of the actuator unit 17 relative to the operation angle of the steering wheel 15 increases when the boat 10 is navigating at low speed. In this case, the outboard motor can be steered sharply even if the operation angle of the steering wheel 15 is small.

The control unit 18 may have a function to automatically control the electromagnetic actuator 73 based on a signal from a sensor for detecting, for example, the engine speed. When the boat 10 is moving slowly, for example, relatively low electric power is supplied to the electromagnetic actuator 73, thereby reducing the steering effort. An alternative computer program may be incorporated such that the steering effort is increased by increasing the electric power supplied to the electromagnetic actuator 73 as the speed of the boat 10 increases.

If the steering wheel 15 is turned up to the foregoing number of turns of helm to the starboard or port side, the control unit 18 supplies the maximum electric power to the electromagnetic actuator 73. Accordingly, the magnetic field of the electromagnetic actuator 73 is maximized, and the inner disks 71 and outer disks 72 are locked to one another. Thereupon, the steering wheel 15 is locked and prevented from further turning. Specifically, the control unit 18 is incorporated with means (a computer program) for supplying the electromagnetic actuator 73 with electric power to lock the inner disks 71 and outer disks 72 when a preset number of turns of helm is reached by the degree of turning the steering wheel 15 from the neutral position.

When the locked state is established by rotating the steering shaft 22 in one direction, the steering wheel 15 cannot be turned further. If the steering wheel 15 is turned in the opposite direction, in contrast, the steering shaft 22 can move within the range of angle θ based on the foregoing gap (play) G. This turning in the opposite direction, that is, the reverse return of the steering shaft 22 from the locked state, is detected by the helm sensor 25. Based on a signal then delivered from the helm sensor 25, the control unit 18 unlocks the friction generating mechanism 23. Thereupon, the steering wheel 15 can turn in the opposite direction.

The following is a description of the steering actuator unit 17.

Figure 8:
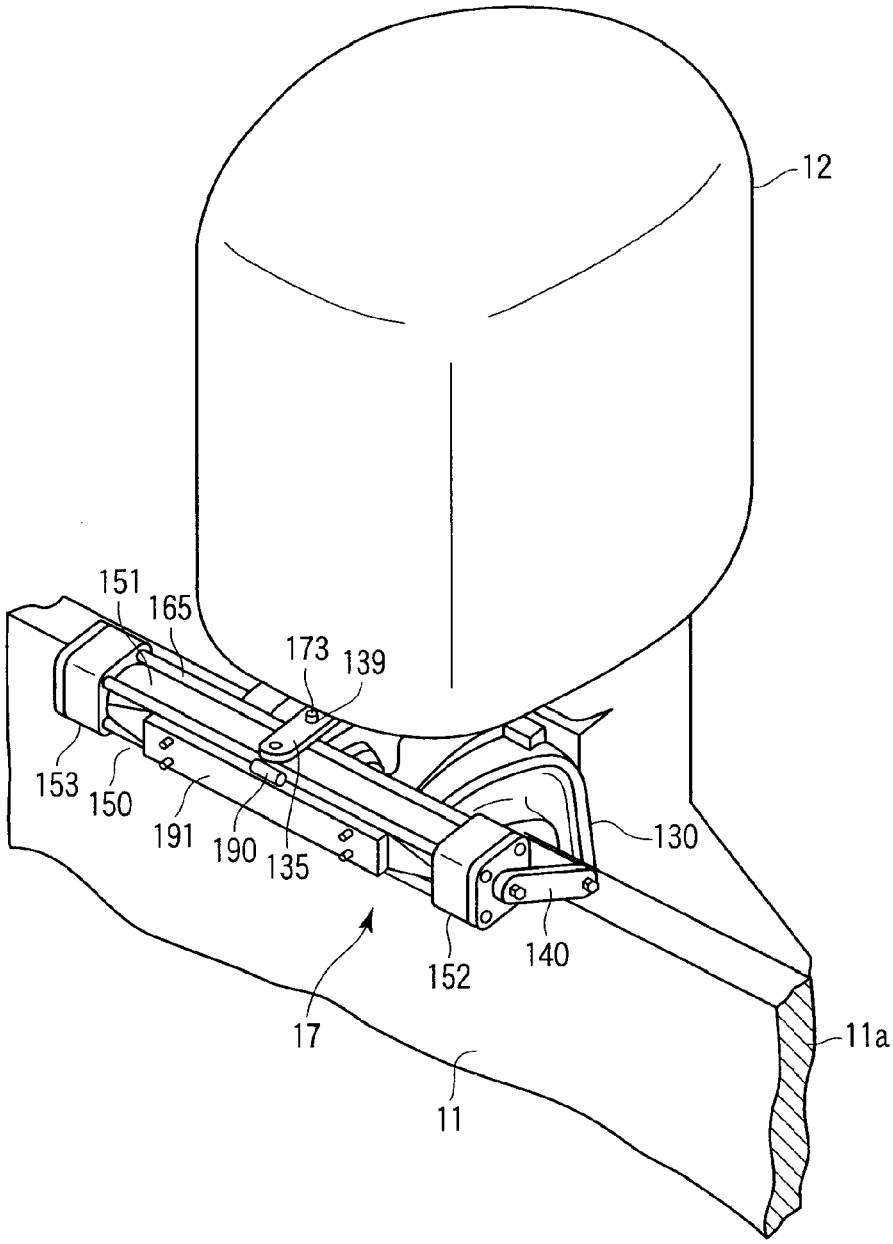
FIG. 8 is a perspective view showing a part of an outboard motor of the boat shown in FIG. 1 and an actuator unit for steering.
Figure 9:
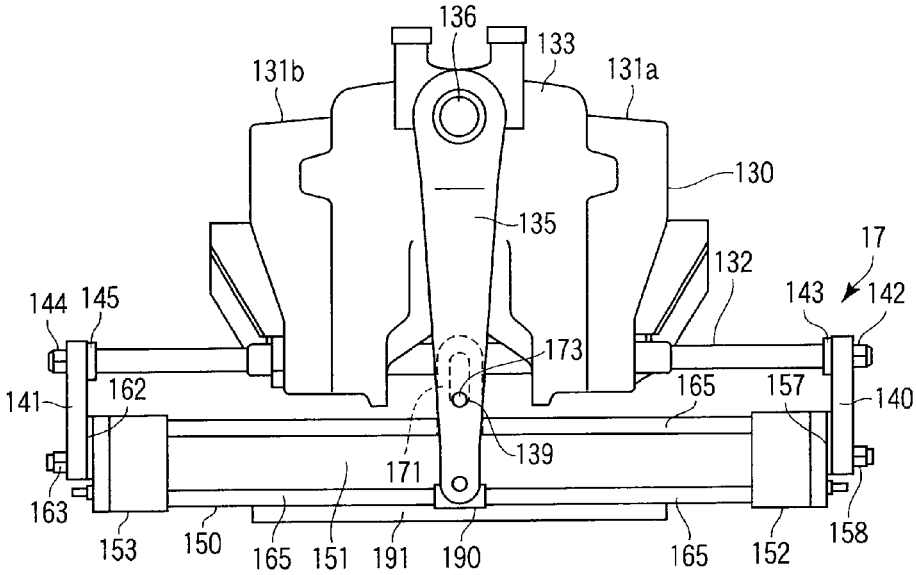
FIG. 9 is a plan view of the actuator unit and a bracket shown in FIG. 8.
Figure 10:
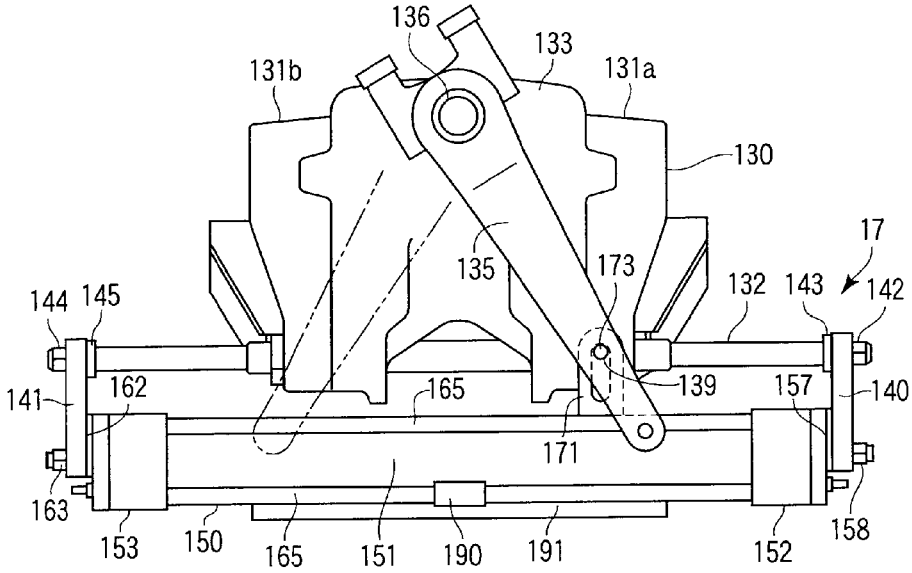
FIG. 10 is a plan view showing a state in which the actuator unit shown in FIG. 8 is on the starboard side.

FIG. 8 shows a part of the outboard motor 12 and the actuator unit 17. The outboard motor 12 is supported on a rear wall 11*a* of the boat body 11 by a bracket 130. FIGS. 9 and 10 are plan views of the actuator unit 17 and bracket 130 taken from above.

The bracket 130 comprises fixed bracket portions 131*a* and 131*b* secured to the boat body 11 and a movable bracket portion 133. The movable bracket portion 133 is movable vertically relative to the fixed bracket portions 131*a* and 131*b* about a tilting shaft 132. The tilting shaft 132 is a shaft that serves as a center around which the outboard motor 12 is tilted up. The tilting shaft 132 extends transversely or horizontally relative to the boat body 11.

The outboard motor 12 is mounted on the movable bracket portion 133. The movable bracket portion 133 can be vertically moved between a tilted-down position and tilted-up position by a tilting drive source such as a hydraulic actuator (not shown). Thus, the outboard motor 12 has a tilt-up function.

The movable bracket portion 133 comprises a steering arm 135 for changing the steering direction of the outboard motor 12. The steering arm 135 can be pivoted laterally about a pivot 136 (FIGS. 9 and 10) on the movable bracket portion 133. The outboard motor 12 can be turned to starboard or port with respect to the boat body 11 by laterally moving the steering arm 135.

FIG. 9 shows the steering arm 135 in a neutral position. When the steering arm 135 is in the neutral position, the outboard motor 12 is in its neutral position corresponding to zero steering angle, so that the boat 10 goes straight. FIG. 10 shows the steering arm 135 on the starboard side. The steering arm 135 can also be moved to port, as indicated by a two-dot chain line in FIG. 10. A receiving portion 139 formed of, for example, a hole is disposed near the distal end portion of the steering arm 135.

The actuator unit 17 comprises a first support arm 140 and second support arm 141. The first support arm 140 is secured to one end of the tilting shaft 132 by a fastener 142 such as a nut. An elastic member 143 with a high spring constant, such as a coned disc spring, is interposed between the first support arm 140 and tilting shaft 132. The second support arm 141 is secured to the other end of the tilting shaft 132 by a fastener 144 such as a nut. An elastic member 145 with a high spring constant, such as a coned disc spring, is interposed between the second support arm 141 and tilting shaft 132.

Figure 11:
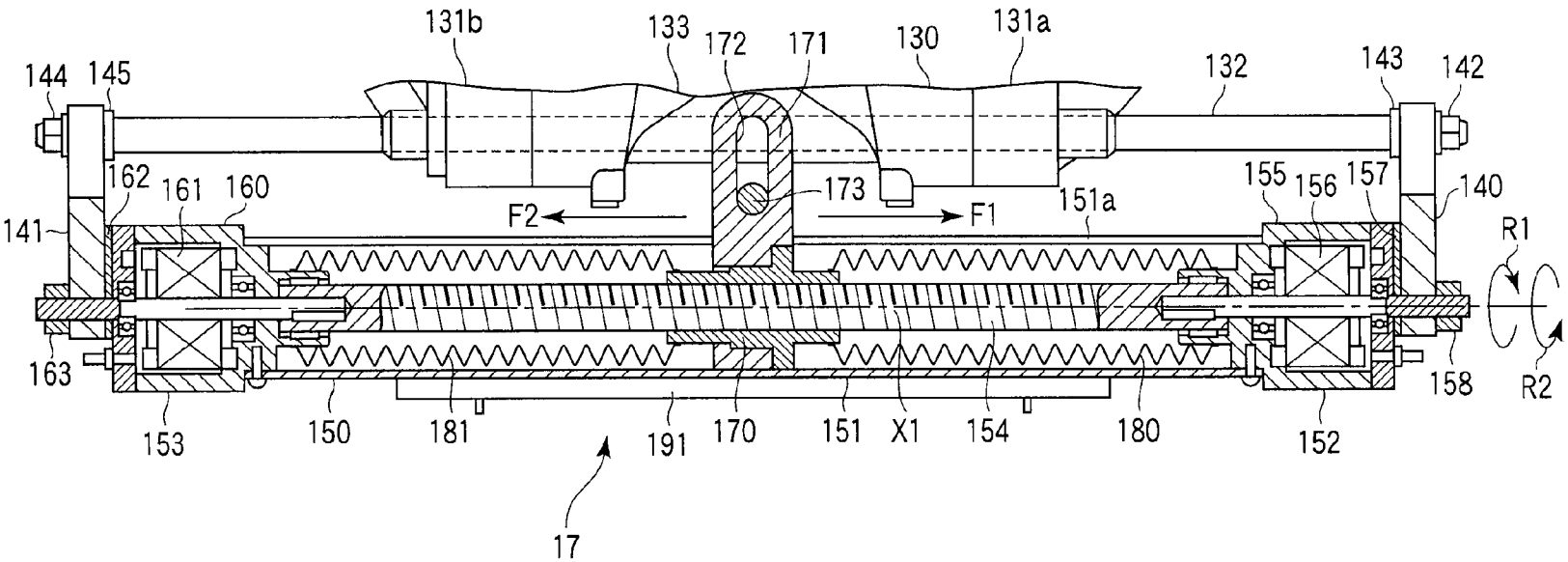
FIG. 11 is a horizontal sectional view of the actuator unit shown in FIG. 8.

The actuator unit 17 comprises an electric actuator 150. The electric actuator 150 is secured to the opposite end portions of the tilting shaft 132 by means of the first and second support arms 140 and 141. FIG. 11 shows a profile of the electric actuator 150. The electric actuator 150 comprises a cover member 151 extending transversely relative to the boat body 11, first electric motor 152, second electric motor 153, feed screw 154, nut member 170 (described later), etc. The first electric motor 152 is mounted near one end of the cover member 151. The second electric motor 153 is mounted near the other end of the cover member 151. The feed screw 154 is rotated by the electric motors 152 and 153. The cover member 151 is disposed parallel to the tilting shaft 132. A slot 151*a* is formed extending along axis $X_1$ of the feed screw 154.

As shown in FIG. 11, the first electric motor 152 comprises a motor body 155 and electrically rotatable rotor 156. The motor body 155 is secured to the first support arm 140 by a fastener 158 such as a nut so that an elastic member 157 with a high spring constant, such as a coned disc spring, is sandwiched between them.

The second electric motor 153 comprises a motor body 160 and electrically rotatable rotor 161. The motor body 160 is secured to the second support arm 141 by a fastener 163 such as a nut so that an elastic member 162 with a high spring constant, such as a coned disc spring, is sandwiched between them. As these electric motors 152 and 153 synchronously rotate in the same direction, torques can be applied from the opposite ends of the feed screw 154 to the feed screw 154.

Four connecting rods 165 are arranged parallel to one another between the motor body 155 of the first electric motor 152 and the motor body 160 of the second electric motor 153. These connecting rods 165 are located outside the cover member 151 and extend along axis $X_1$ (FIG. 11) of the feed screw 154. The motor body 155 of the first electric motor 152 and the motor body 160 of the second electric motor 153 are connected to each other by these connecting rods 165.

The feed screw 154 is disposed inside the cover member 151. The feed screw 154 has axis $X_1$ extending longitudinally relative to the cover member 151. The feed screw 154 can be rotated in first direction R1 or second direction R2 (FIG. 11) by torques produced by both the first electric motor 152 and second electric motor 153.

The nut member 170 is accommodated within the cover member 151. The nut member 170 comprises a spiral circulation path defined therein and a large number of balls that circulate in the circulation path. The nut member 170 is threadedly engaged with the feed screw 154 for rotation by means of the balls. If the feed screw 154 rotates relative to the nut member 170, the nut member 170 moves in accordance with the direction and amount of rotation of the feed screw 154. Specifically, the nut member 170 reciprocates in first direction F1 or second direction F2 (FIG. 11) along axis $X_1$ within the cover member 151. The feed screw 154 and nut member 170 constitute a ball screw mechanism.

The nut member 170 is provided with a drive arm 171. The drive arm 171 moves integrally with the nut member 170 in first direction F1 or second direction F2 along the slot 151*a* in the cover member 151. An engaging member 173 formed of, for example, a pin or bolt is inserted into a slot 172 in the drive arm 171. The engaging member 173 is movable longitudinally relative to the drive arm 171 along the slot 172.

The engaging member 173 is connected to the receiving portion 139 of the steering arm 135. When the drive arm 171 moves in first direction F1 or second direction F2, the engaging member 173 moves in the same direction as the drive arm 171, whereupon the steering arm 135 moves to starboard or port.

A pair of protective boots 180 and 181 are accommodated inside the cover member 151. The protective boots 180 and 181 consist mainly of synthetic resin or rubber. The one protective boot 180 is disposed between the first electric motor 152 and nut member 170. The other protective boot 181 is disposed between the second electric motor 153 and nut member 170. These protective boots 180 and 181 are in the form of bellows, which can extend and contract along axis $X_1$ of the feed screw 154. The protective boots 180 and 181 cover the feed screw 154.

The actuator unit 17 of the present embodiment comprises a neutral position sensor 190 for detecting the location of the steering arm 135 in the neutral position and a steering angle sensor 191 for detecting the steering angle of the steering arm 135. When the steering arm 135 is in the neutral position, a signal indicative of the neutral position is output from the neutral position sensor 190 to the control unit 18.

The following is a description of the operation of the steering apparatus 13.

When the steering wheel 15 is turned, the degree of turning (steering angle) is detected by the helm sensor 25, and electrical signals indicative of the turning direction and steering angle are delivered to the control unit 18. The control unit 18 rotates the first and second electric motors 152 and 153 so that a target steering angle output from the helm sensor 25 to the control unit 18 is equal to an actual steering angle of the outboard motor 12 detected by the steering angle sensor 191.

As the first and second electric motors 152 and 153 rotate in the same direction, the respective torques of the electric motors 152 and 153 are input to the feed screw 154 through the opposite ends of the feed screw 154. When the feed screw 154 rotates, the nut member 170 and drive arm 171 move in first direction F1 or second direction F2 (FIG. 11) in accordance with the amount and direction of rotation of the feed screw 154.

The position of the drive arm 171, that is, the steering angle of the steering arm 135, is detected by the steering angle sensor 191. The control unit 18 uses the neutral position of the steering arm 135, which is detected by the neutral position sensor 190, as a reference position for the steering angle. The electric motors 152 and 153 are controlled so that the actual steering angle of the steering arm 135 detected by the steering angle sensor 191 is equal to the target steering angle delivered from the helm sensor 25.

If the steering wheel 15 is turned to starboard, for example, the first and second electric motors 152 and 153 rotate in first direction R1 (FIG. 11). Accordingly, the drive arm 171 moves in first direction F1. When the steering angle detected by the steering angle sensor 191 becomes equal to the target steering angle, the first and second electric motors 152 and 153 stop, and the drive arm 171 also stops. As this is done, the one protective boot 180 contracts, while the other protective boot 181 extends.

If the steering wheel 15 is turned to port, in contrast, the first and second electric motors 152 and 153 rotate in second direction R2. Accordingly, the drive arm 171 moves in second direction F2 (FIG. 11). When the steering angle detected by the steering angle sensor 191 becomes equal to the target steering angle, the first and second electric motors 152 and 153 stop, and the drive arm 171 also stops. As this is done, the one protective boot 180 extends, while the other protective boot 181 contracts.

According to the steering apparatus 13 of the present embodiment, the electromagnetic actuator 73 of the friction generating mechanism 23 in the helm device 20 is controlled by the control unit 18. The boat operator can adjust the operating force (resistance) or play of the steering wheel 15 or adjust the number of turns of helm by operating the adjustment control unit 110. Since the electromagnetic actuator 73 is controlled based on signals from various sensors input to the control unit 18, moreover, the helm unit 16 can be automatically adjusted to provide a suitable state for boat handling conditions.

In case of discontinuity due to power supply trouble of the electromagnetic actuator 73, moreover, the assist spring 24 can apply resistance to the turning of the steering wheel 15. Such a problem can be avoided that the operation of the steering wheel 15 becomes lighter suddenly and unexpectedly.

Figure 12:
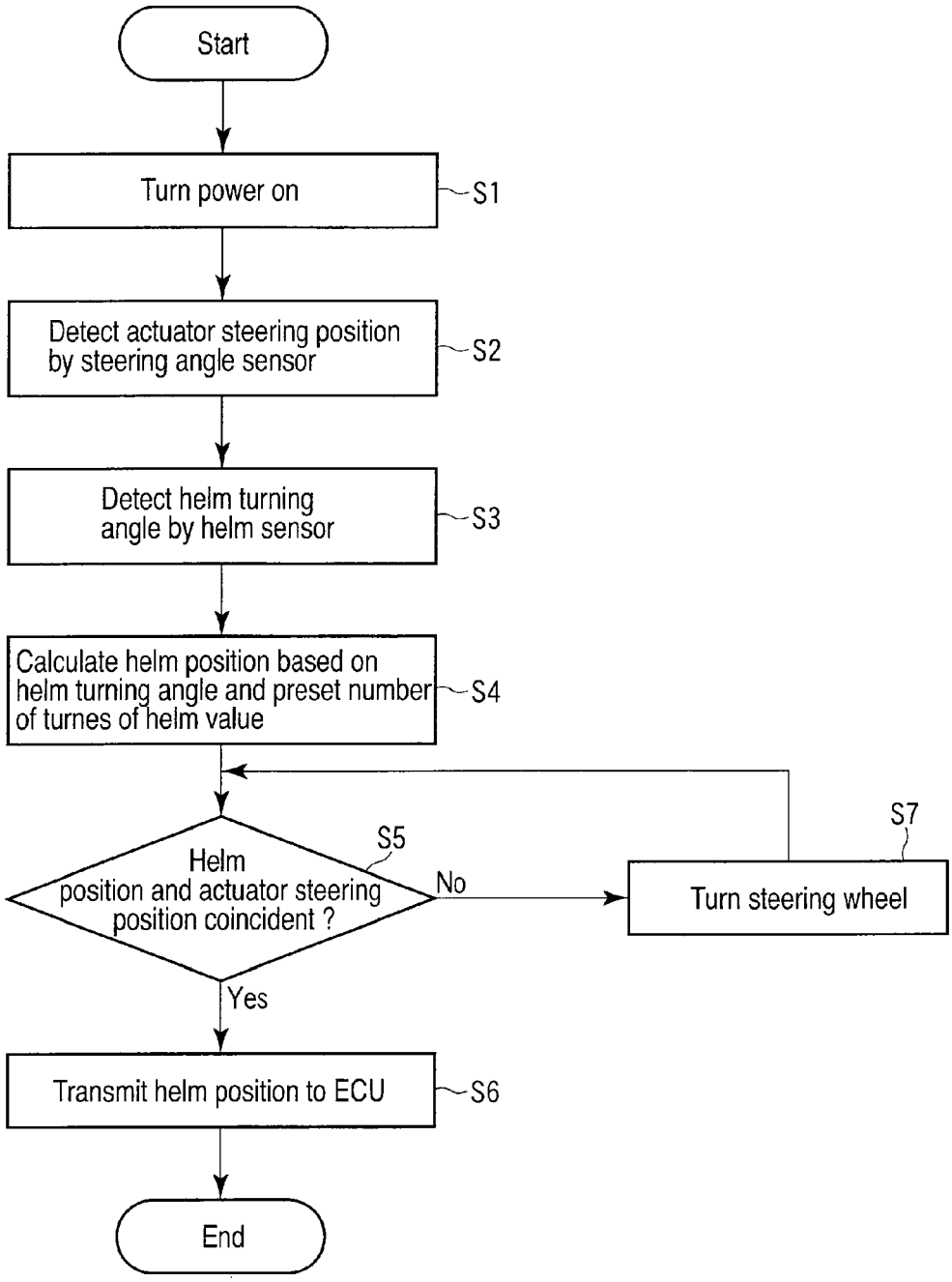
FIG. 12 is a flowchart showing a flow of power-on processing of the steering apparatus shown in FIG. 1.

In the helm device 20 of the present embodiment, the steering wheel 15 becomes freely turnable without regard to the orientation of the outboard motor 12 when the power switch 19 is turned off. In the power-off state, therefore, the orientation of the outboard motor 12 does not correspond to the steering position of the steering wheel 15. Accordingly, the control unit 18 comprises a computer program for performing power-on processing shown in FIG. 12 and a computer program for performing post-startup processing shown in FIG. 13. Referring to FIG. 12, the power-on processing will be described first.

If the power switch 19 is turned on in Step S1 in FIG. 12, the program proceeds to Step S2. In Step S2, the steering position of the steering arm 135, that is, an "actuator steering position", is detected by the steering angle sensor 191. Thereafter, the program proceeds to Step S3.

In Steps S3, the turning angle of the steering wheel 15, that is, a "helm turning angle", is detected by the helm sensor 25. In Step S4, a "helm position" is calculated based on the "helm turning angle" and a "preset number of turns of helm value" previously set by the setting section 113 for setting number of turns of helm.

In Step S5, it is determined whether or not the "helm position" is coincident with the "actuator steering position". If the "helm position" and "actuator steering position" are coincident, the program proceeds to Step S6. If the "helm position" and "actuator steering position" are not coincident, the steering wheel 15 is turned, whereupon the program returns to Step S5. Since the "helm position" and "actuator steering position" coincide when turning the steering wheel 15, the program proceeds to Step S6. In Step S6, the "helm position" is transmitted to a central processing unit (CPU) of the control unit 18.

By performing the power-on processing described above, according to the present embodiment, the position of the steering wheel 15 (helm position) and the orientation of the outboard motor 12 (actuator steering position) can be made to correspond to each other when the power switch 19 is turned on. After the power-on processing is finished, the program proceeds to the normal post-startup processing shown in FIG. 13.

Figure 13:
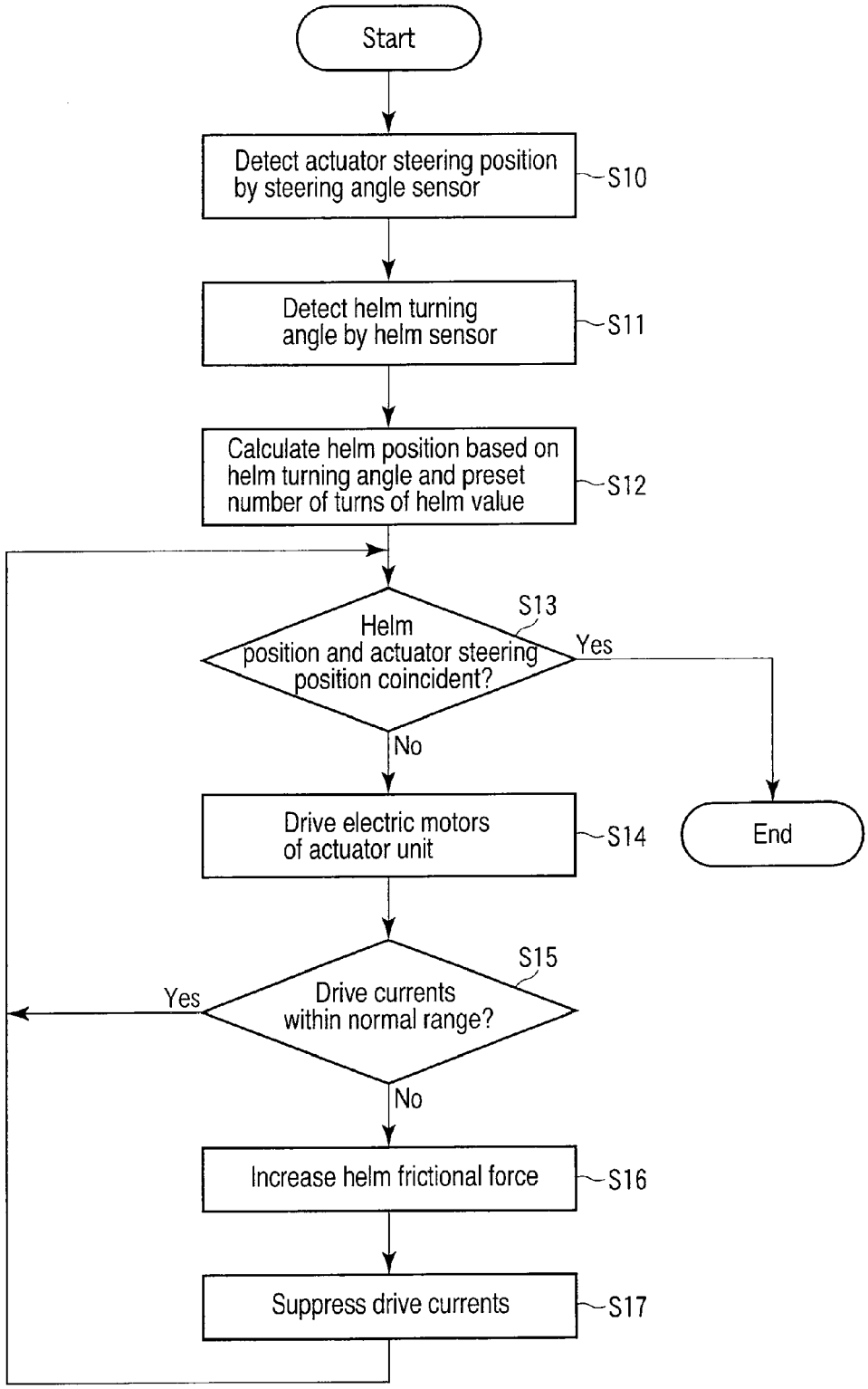
FIG. 13 is a flowchart showing a flow of post-startup processing of the steering apparatus shown in FIG. 1.

The following is a description of the post-startup processing (normal processing) shown in FIG. 13.

In Step S10 shown in FIG. 13, the steering position of the steering arm 135, that is, the "actuator steering position", is detected by the steering angle sensor 191. Thereafter, the program proceeds to Step S11. In Step S11, the turning angle of the steering wheel 15, that is, the "helm turning angle", is detected by the helm sensor 25. In Step S12, the "helm position" is calculated based on the "helm turning angle" and the "preset number of turns of helm value" previously set by the setting section 113 for setting number of turns of helm.

In Step S13, it is determined whether or not the "helm position" and "actuator steering position" are coincident. If the "helm position" and "actuator steering position" are not coincident, the program proceeds to Step S14. If it is determined in Step S13 that the "helm position" and "actuator steering position" are coincident, the actual steering angle is equal to the target steering angle, so that the electric motors 152 and 153 are stopped, whereupon the program terminates.

In Step S14, the electric motors 152 and 153 of the actuator unit 17 are rotated, and the program then proceeds to Step S15. In Step S15, it is determined whether or not drive currents supplied to the electric motors 152 and 153 are in excess of a normal range. If the drive currents are within the normal range, the program returns to Step S13.

If the electric motors 152 and 153 fail to rotate normally due to some trouble with the actuator unit 17, the drive currents become higher than in the normal state. If it is then determined in Step S15 that the drive currents are in excess of the normal range, the program proceeds to Step S16.

In Step S16, the current supplied to the electromagnetic actuator 73 of the helm device 20 is increased, thereby making the frictional force of the friction generating mechanism 23 greater than in the normal state. Thereupon, the necessary power to turn the steering wheel 15 increases, so that the boat operator can recognize the occurrence of some trouble with the actuator unit 17 and take necessary measures against it.

In Step S17, the passage of excessive currents through the electric motors 152 and 153 can be avoided by suppressing the drive currents of the electric motors 152 and 153. In this way, the electric motors 152 and 153 can be protected.

Figure 14:
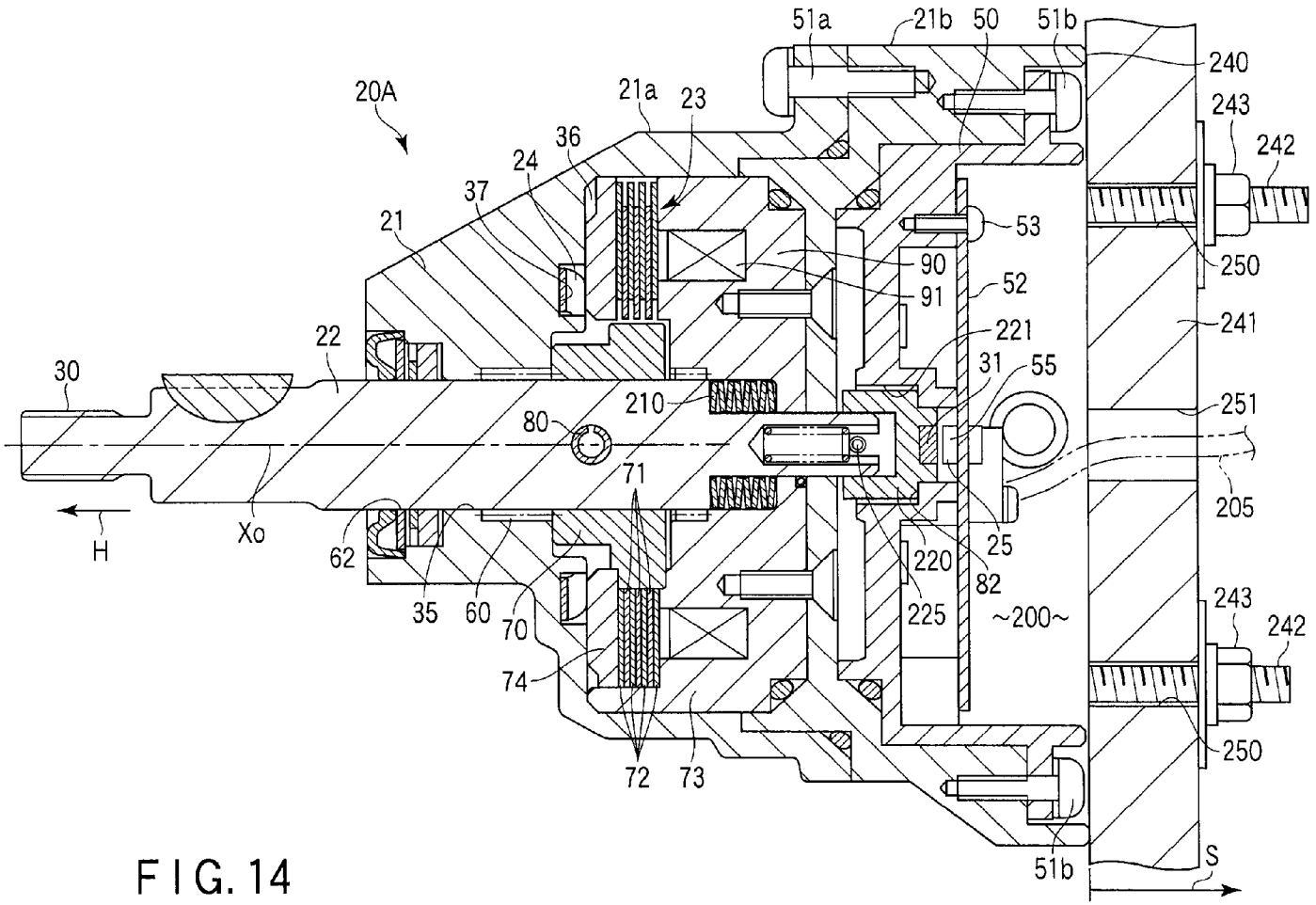
FIG. 14 is a sectional view of a helm device according to a second embodiment of the present invention.
Figure 15:
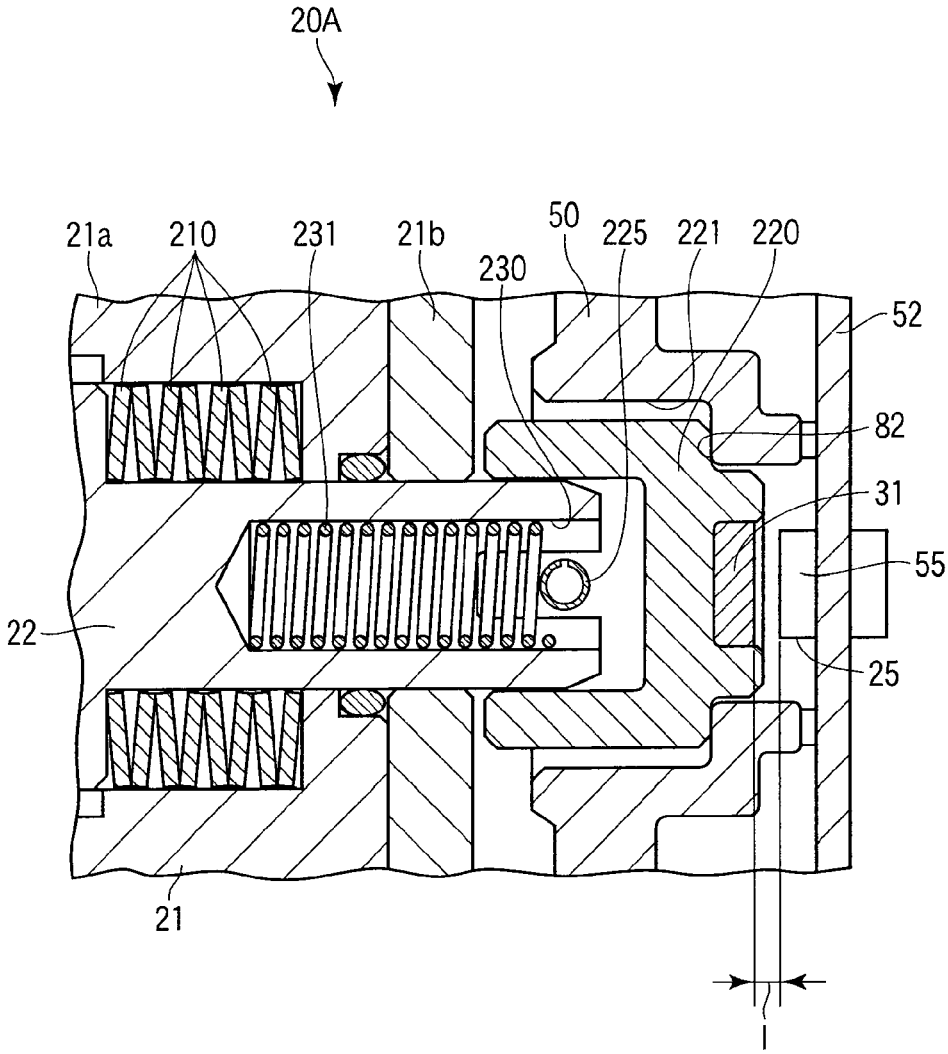
FIG. 15 is an enlarged sectional view showing a part of the helm device shown in FIG. 14.

FIGS. 14 and 15 show a helm device 20A according to a second embodiment of the present invention. FIG. 15 is a partially enlarged sectional view of the helm device 20A. The following is a description of the helm device 20A. Common numerals are used to designate those parts of the helm device 20A shared with the helm device 20 of the first embodiment (FIGS. 1 to 7).

A case 21 of the helm device 20A comprises a first case member 21*a* and second case member 21*b*. The second case member 21*b* is secured to the first case member 21*a* by fixing members 51*a*. A cover member 50 is inserted into the second case member 21*b*. The cover member 50 is secured to the second case member 21*b* by fixing members 51*b*. A circuit board 52 comprising a helm sensor 25 is accommodated in a recess 200 formed in the cover member 50. The circuit board 52 is secured to the cover member 50 by fixing members 53. A conducting member 205 (part of which is shown in FIG. 14) is electrically conductive to the circuit board 52.

An elastic member 210 formed of, for example, a coned disc spring is disposed near that end portion of a steering shaft 22 which is located within the case 21. The steering shaft 22 is urged by the elastic member 210 in a direction (indicated by arrow H in FIG. 14) such that it projects from the case 21. The elastic member 210, which is configured to be deformed when subjected to a load applied along axis $X_0$ of the steering shaft 22, also has a function to absorb vibration along axis $X_0$ or the like.

A holder member 220 is disposed on that end portion of the steering shaft 22 within the case 21. The holder member 220 is inserted into a recess 221 formed in the central part of the cover member 50. This holder member 220 is supported for rotation about axis $X_0$ of the steering shaft 22 by a support base 82. The holder member 220 is rotatable relative to the case 21 about axis $X_0$.

A magnet 31 as an example of a member to be detected is disposed on an end surface of the holder member 220. The magnet 31 is located on an extension of axis $X_0$ of the steering shaft 22. The circuit board 52 is provided with the helm sensor 25. The helm sensor 25 comprises an element 55 for detecting the rotational position of the steering shaft 22 by means of the magnetism of the magnet 31.

The holder member 220 comprises a rod-like connecting member 225 in the form of a pin or the like. This connecting member 225 extends radially relative to the holder member 220. The steering shaft 22 and holder member 220 are connected to each other by the connecting member 225. The holder member 220 is rotatable together with the steering shaft 22. In addition, the holder member 220 is movable relative to the steering shaft 22 along axis $X_0$.

A hole 230 extending along axis $X_0$ is formed in the end portion of the steering shaft 22. A spring member 231 formed of, for example, a compression coil spring is accommodated in the hole 230. The spring member 231 is compressed between the connecting member 225 and the inner wall of the hole 230. The holder member 220 is urged toward the helm sensor 25 by the spring member 231.

Thus, the holder member 220 is held so that its position relative to the helm sensor 25 along axis $X_0$ is constant without regard to the position of the steering shaft 22 along axis $X_0$. If the position of the steering shaft 22 is deviated along axis $X_0$, therefore, distance I (shown in FIG. 15) from the member to be detected (magnet 31) to the helm sensor 25 can be kept constant, so that the helm sensor 25 can constantly output stable signals.

As shown in FIG. 14, an end surface 240 of the case 21 is supported in contact with a helm mounting wall 241 on the boat body part. The helm device 20A is secured to the helm mounting wall 241 by a plurality of mounting bolts 242 projecting toward the helm mounting wall 241 and nut members 243 threadedly engaged with the bolts 242. The mounting bolts 242 are attached to the case 21. The mounting bolts 242 project from the end surface 240 of the case 21 into an area S (FIG. 14) on the boat body part. The mounting bolts 242 are inserted individually into first through-holes 250 formed in the helm mounting wall 241.

The end surface 240 of the case 21 is in contact with the helm mounting wall 241. A waterproof packing or the like may be disposed between the end surface 240 and helm mounting wall 241. The nut members 243 are threadedly engaged with the mounting bolts 242 from inside the helm mounting wall 241. The helm device 20A is secured to the helm mounting wall 241 by tightening the nut members 243. The helm mounting wall 241 is formed with a second through-hole 251 through which the conducting member 205 is to be passed.

In this helm device 20A, various electrical circuit components mounted on the circuit board 52 are accommodated in the recess 200 inside the case 21. In other words, only the conducting member 205 and mounting bolts 242 project from the end surface 240 of the case 21 toward the helm mounting wall 241. Therefore, the helm mounting wall 241 must only be bored with the small through-holes 250 through which the mounting bolts 242 are to be passed and the small through-hole 251 through which the conducting member 205 is to be passed. Thus, the through-holes 250 and 251 formed in the helm mounting wall 241 are allowed to be smaller than large-diameter holes that used to be formed in the helm mounting wall to mount a conventional hydraulic helm device, so that machining work and the like for the through-holes 250 and 251 are simple.

Since other configurations and functions are common to the helm device 20A described above and the helm device 20 of the first embodiment (FIGS. 1 to 7), common numerals are used to designate their common parts, and a description thereof is omitted.

Figure 16:
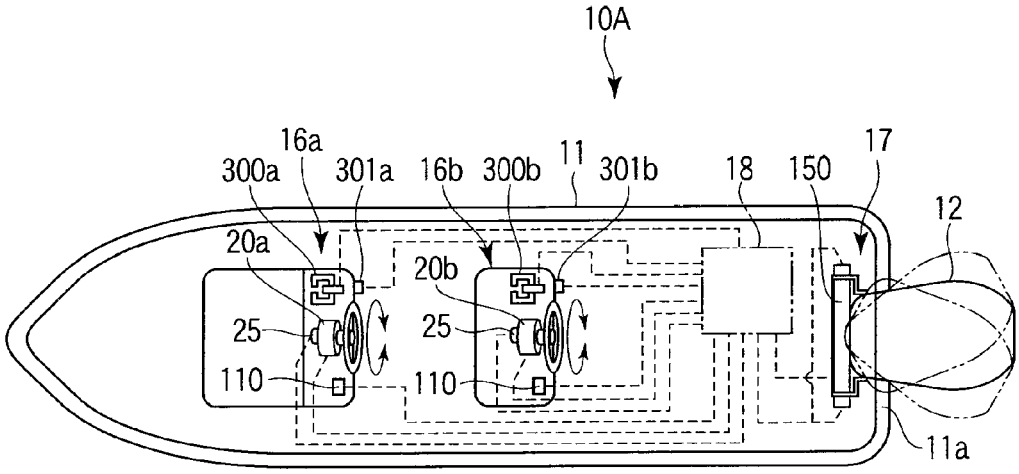
FIG. 16 is a plan view of a boat comprising a steering apparatus according to a third embodiment of the present invention.

FIG. 16 shows a boat 10A comprising a steering apparatus according to a third embodiment of the present invention. An actuator unit 17 as a drive source for changing the orientation of an outboard motor 12 is constructed in the same manner as the actuator unit 17 of the first embodiment. This boat 10A comprises a first control system comprising a first helm unit 16*a* and a second control system comprising a second helm unit 16*b*. A first helm device 20*a*, first remote-control engine control device 300*a*, and first change-over switch 301*a* are arranged on the first helm unit 16*a*. A second helm device 20*b*, second remote-control engine control device 300*b*, and second change-over switch 301*b* are arranged on the second helm unit 16*b*.

The first helm device 20*a* and second helm device 20*b* are individually constructed in the same manner as the helm device 20A described above. If the first change-over switch 301*a* is turned on, signals from the first helm device 20*a* and first engine control device 300*a* start to be input to a control unit 18. Thus, the first control system is activated. When the first control system is activated, control of the actuator unit 17 by the first helm device 20*a* and engine control (shift operation and throttle control) of the outboard motor 12 by the first engine control device 300*a* are performed.

If the second change-over switch 301*b* is turned on, signals from the second helm device 20*b* and second engine control device 300*b* start to be input to a control unit 18. Thus, the control system is changed to the second control system. When the second control system is activated, control of the actuator unit 17 by the second helm device 20*b* and engine control (shift operation and throttle control) of the outboard motor 12 by the second engine control device 300*b* are performed.

Thus, according to the steering apparatus of the boat 10A of the present embodiment, the control system, of the first and second control systems, to be used by a boat operator can be changed for activation by means of the change-over switches 301*a* and 301*b*. Since other configurations are common to the steering apparatus of this boat 10A and the steering apparatuses 13 of the boats 10 of the first and second embodiments, common numerals are used to designate those parts shared with the first and second embodiments, and a description thereof is omitted.

The steering apparatus of the present invention is applicable to various types of boats with an outboard motor. It is to be understood, in carrying out the present invention, that the configurations, layouts, etc., of the constituent members of the steering apparatus, including the case of the helm device, steering shaft, friction generating mechanism, assist spring, helm sensor, inner disks, outer disks, electromagnetic actuator, and control unit, may be embodied in variously modified forms.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A steering apparatus for an outboard motor comprising a helm device, the helm device comprising a case, a steering shaft rotatably disposed in the case and configured to be rotated by a steering wheel, a helm sensor configured to detect a rotation of the steering shaft, and a friction generating mechanism accommodated in the case, the friction generating mechanism comprising an inner disk configured to rotate together with the steering shaft, an outer disk opposed to the inner disk, an electromagnetic actuator, an armature configured to move in such a direction as to press the inner disk and the outer disk against each other when the electromagnetic actuator is supplied with electric power, and an assist spring configured to urge the armature in the direction to press the inner disk and the outer disk against each other.

2. The steering apparatus according to claim 1, which comprises a control unit which controls the electromagnetic actuator and means for changing the electric power supplied to the electromagnetic actuator, thereby changing a frictional force produced between the inner disk and the outer disk of the friction generating mechanism.

3. The steering apparatus according to claim 2, which comprises an adjustment control unit capable of setting the frictional force of the friction generating mechanism.

4. The steering apparatus according to claim 2, wherein the control unit comprises means for supplying the electromagnetic actuator with electric power such that the inner disk and the outer disk are brought into a locked state when a preset number of turns is reached by the number of turns of the steering wheel starting from a neutral position.

5. The steering apparatus according to claim 4, which comprises an adjustment control unit capable of setting a number of turns of helm at which the steering wheel is turnable before the locked state is established starting from the neutral position.

6. The steering apparatus according to claim 4, which comprises a rotor configured to rotate together with the steering shaft, a spline formed on the rotor, a tooth portion formed on the inner disk and configured to engage with the spline, and a gap defined between the spline and the tooth portion and configured to allow the steering shaft to pivot relative to the inner disk through or beyond an angle exceeding the angle-detection resolution of the helm sensor when the inner disk and the outer disk are in the locked state.

7. The steering apparatus according to claim 6, wherein a plurality of the inner disks are arranged along an axis of the steering shaft, and which further comprises an alignment member for aligning the positions of the respective tooth portions of the inner disks with one another.

8. The steering apparatus according to claim 1, which comprises a holder member disposed on an end portion of the steering shaft and movable along the axis of the steering shaft, a member to be detected disposed on the holder member, and a spring member disposed in the steering shaft and configured to urge the holder member toward the helm sensor, thereby keeping the distance from the member to be detected to the helm sensor constant.

9. The steering apparatus according to claim 1, which comprises a circuit board accommodated in the case, an end surface formed on the case and supported on a helm mounting wall on a boat body, first and second through-holes formed in the helm mounting wall, a mounting bolt projecting from the end surface of the case toward the helm mounting wall and inserted into the first through-hole, and a conducting member electrically connected to the circuit board and inserted into the second through-hole.

10. The steering apparatus according to claim 1, which further comprises an actuator unit for steering, a control unit, and a power switch, the control unit comprising means configured to detect a steering position of the actuator unit when the power switch is turned on, means configured to calculate a helm position based on a helm turning angle detected by the helm sensor and a preset number of turns of helm value, means configured to determine whether or not the helm position is coincident with the steering position of the actuator unit, and means configured to transmit the helm position to a CPU of the control unit when the helm position and the steering position of the actuator unit are coincident.

11. The steering apparatus according to claim 10, wherein the control unit comprises means configured to supply a drive current to the actuator unit when the helm position and the steering position of the actuator unit are not coincident, means configured to determine whether or not the drive current is in excess of a normal range, and means configured to increase the frictional force of the friction generating mechanism when the drive current is in excess of the normal range.

12. The steering apparatus according to claim 1, which comprises an actuator unit for steering, a first helm unit on which a first helm device, a first engine control device, and a first change-over switch are arranged, a second helm unit on which a second helm device, a second engine control device, and a second change-over switch are arranged, and switch means configured to activate control by the first helm device and the first engine control device when the first change-over switch is turned on and to activate control by the second helm device and the second engine control device when the second change-over switch is turned on.

* * * * *